US008317664B2

(12) United States Patent
Gorsuch et al.

(10) Patent No.: US 8,317,664 B2
(45) Date of Patent: Nov. 27, 2012

(54) PORTABLE EXERCISE DEVICE

(75) Inventors: Matthew David Gorsuch, Lake Villa, IL (US); Daniela Suzanne Gorsuch, Lake Villa, IL (US)

(73) Assignees: Matthew D. Gorsuch, Lake Villa, IL (US); Daniela S. Gorsuch, Lake Villa, IL (US)

( * ) Notice: Subject to any disclaimer, the term of this patent is extended or adjusted under 35 U.S.C. 154(b) by 144 days.

(21) Appl. No.: 12/825,000

(22) Filed: Jun. 28, 2010

(65) Prior Publication Data

US 2010/0331155 A1 Dec. 30, 2010

Related U.S. Application Data

(60) Provisional application No. 61/221,394, filed on Jun. 29, 2009.

(51) Int. Cl.
*A63B 22/04* (2006.01)

(52) U.S. Cl. ..... 482/52; 482/41; 211/149

(58) Field of Classification Search ..... 482/140–142, 482/148, 95–97, 52; 211/149
See application file for complete search history.

(56) References Cited

U.S. PATENT DOCUMENTS

| | | | | |
|---|---|---|---|---|
| 4,046,374 | A * | 9/1977 | Breyley | 482/68 |
| 4,505,476 | A | 3/1985 | Rubin | |
| 4,815,732 | A * | 3/1989 | Mahvi | 482/142 |
| 5,127,647 | A | 7/1992 | Wilkinson | |
| 5,152,732 | A | 10/1992 | Sayre | |
| 5,257,701 | A * | 11/1993 | Edelson | 211/149 |
| 5,518,476 | A | 5/1996 | McLeon | |
| 5,895,342 | A | 4/1999 | Solland | |
| 5,897,464 | A | 4/1999 | Mcleod | |
| 7,169,098 | B1 | 1/2007 | McGanty | |
| 7,494,454 | B2 | 2/2009 | Sheets | |
| 7,611,442 | B1 * | 11/2009 | Myrland | 482/15 |
| 7,674,210 | B2 * | 3/2010 | Girardin | 482/122 |
| 2005/0130814 | A1 | 6/2005 | Nitta et al. | |
| 2006/0135329 | A1 | 6/2006 | Owen | |
| 2008/0214369 | A1 | 9/2008 | Mancini | |

* cited by examiner

*Primary Examiner* — Stephen Crow
(74) *Attorney, Agent, or Firm* — Matthew D. Gorsuch; Daniela S. Gorsuch; Pro Se

(57) ABSTRACT

A portable exercise device including a support structure and a pair of opposing handrails pivotably connected to the support structure. The handrails are movable between a storage position and a use position. A platform is selectively positionable on the handrails for adjusting a vertical position of the platform relative to the handrails.

5 Claims, 9 Drawing Sheets

PORTABLE EXERCISE DEVICE

PRIORITY CLAIM

This application claims priority to and the benefit of U.S. Provisional Application No. 61/221,394 filed on Jun. 29, 2009.

BACKGROUND

The present invention relates generally to exercise equipment, and more particularly to a portable exercise device that can be used in different locations for physical fitness and physical therapy.

Regular exercise is vital to a person's physical fitness and can help protect a person from heart disease, stroke, and other health maladies such as high blood pressure, noninsulin-dependent diabetes, obesity, back pain and osteoporosis. Exercise also can improve a person's mood, help to manage stress and help a person recover from an injury through physical therapy.

Many people exercise at gyms having exercise equipment such as treadmills, exercise bikes and machines. Other people purchase their own exercise equipment for exercising at home.

Exercising becomes difficult and expensive for people who travel, however, because many hotels do not have exercise rooms or the exercise rooms have limited equipment. Furthermore, many travelers have to pay to use a local gym, which can be expensive if they are staying at a particular location for an extended period of time. Also, smaller towns do not tend to have gyms and therefore travelers are forced to drive a long distance to a gym, which is inconvenient, or not exercise at all.

Additionally, conventional exercise equipment used for step-up and step-down progressions, push-up progressions, stable single leg training exercises and progressive sit to stand exercises is typically large, bulky and difficult to use for physically unstable persons, persons with disabilities and persons rehabbing injuries. Furthermore, such equipment is not readily portable between locations.

SUMMARY

The present portable exercise device provides a single, portable device for use in physical fitness and physical therapy that allows a user to perform several exercises at varying levels of difficulty in different locations.

More specifically, a portable exercise device is provided that includes a support structure and a pair of opposing handrails pivotably connected to the support structure. The handrails are movable between a storage position and a use position. A platform is selectively positionable on the handrails for adjusting a vertical position of the platform relative to the handrails.

In another embodiment, a portable exercise device is provided that includes a foldable support structure, a pair of opposing handrails connected to the support structure and a platform selectively positionable on the handrails for adjusting a vertical position of the platform relative to the handrails. The handrails are movable between a use position, wherein the handrails are substantially transverse to the support structure, and a storage position, wherein support structure is folded enabling the handrails to be moved inwardly until the handrails are adjacent to each other.

DETAILED DESCRIPTION

Referring to FIGS. 1-9, the present exercise device generally provides a single portable device for use in physical fitness and physical therapy that allows the user to perform several exercises at varying levels of difficulty in different locations.

The present exercise device includes a support structure 1, right and left handrails 2*a*, 2*b*, an array of attachment ports or socks 8-31 and a removable platform including platform feet 32. The exercise device may optionally include a platform cover.

Figure 1:
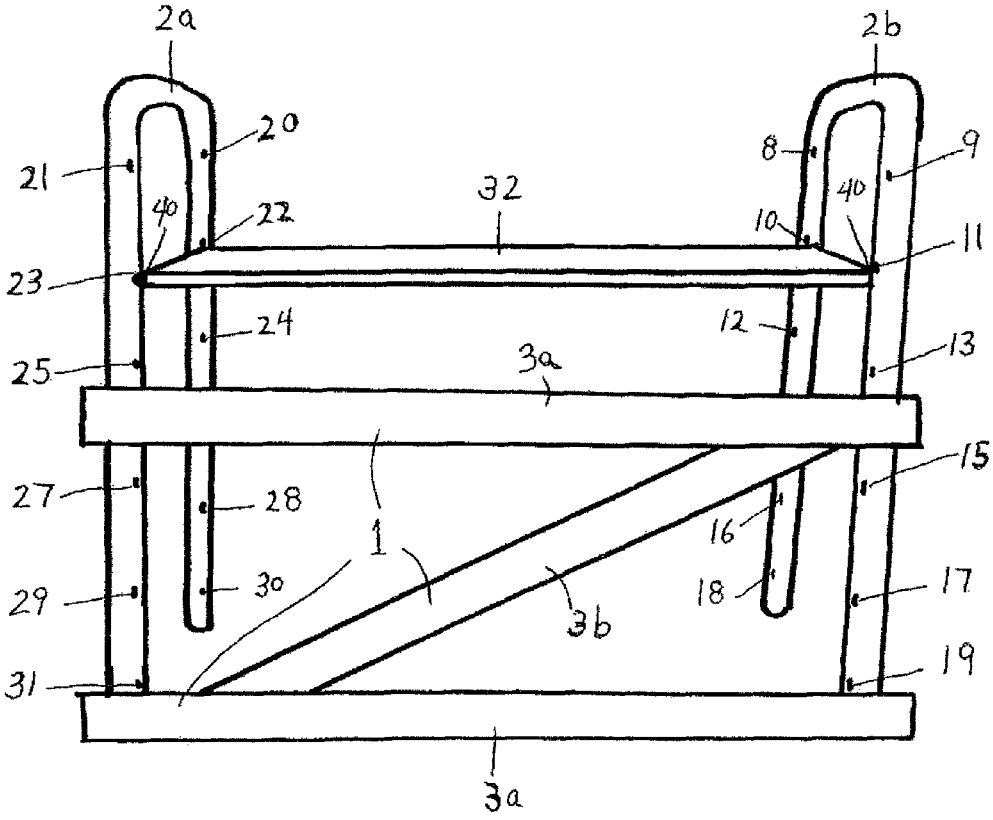
FIG. 1 is a front perspective view of an embodiment of the present portable exercise device.
Figure 2:
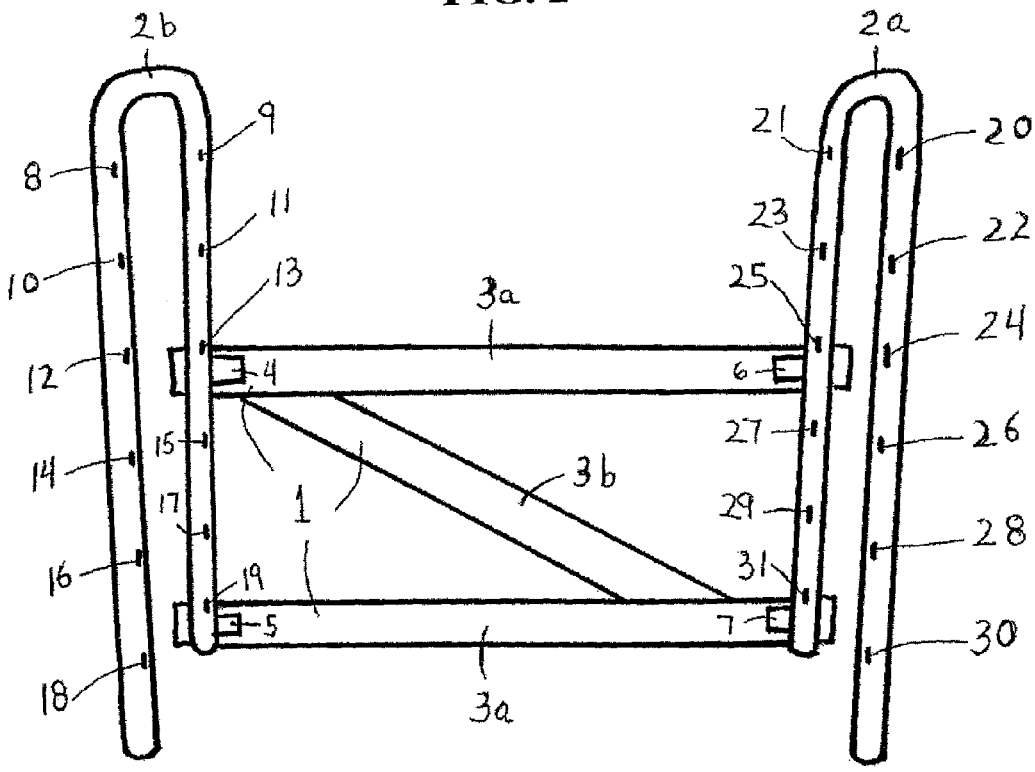
FIG. 2 is a front perspective view of the embodiment of FIG. 1 with the platform removed and the support is cross-braced with horizontal straps and a diagonal strap.

Referring now to FIGS. 1 and 2, the support structure 1 includes two horizontal straps 3*a* and one diagonal strap 3*b* that are welded together. In another embodiment shown in FIG. 3, the support structure 1 has a bi-fold back panel 3*c*. The material used to build the support structure 1 is preferably metal but the support structure can be made with any suitable material such as metal, wood, plastic, synthetic materials, or other material of suitable strength.

The left handrail 2*b* and the right handrail 2*a* are each generally arch-shaped and have a flat top surface. In a preferred embodiment, the handrails 2*a*, 2*b* are each approximately 42 inches in height and 20 inches in width. It should be appreciated that the handrails may be any suitable height and width. The handrails 2*a*, 2*b*, are connected to the support structure 1 using a means that will allow them to pivot or swing in and out like cabinet doors from a storage position where the handrails are pivoted inwardly against the support structure, and a use position where the handrails are transverse to the support structure (FIG. 1). The means can be the hinges 4, 5, 6 and 7 which, in a preferred embodiment, are traditional door hinges or any suitable types of hinges. The parts of the handrails 2*a*, 2*b* can be made of materials that are for example metal, plastic, wood, or synthetic material, but are not limited such materials and may be any suitable material or combination of materials.

There are at least two vertical sections of each of the handrails 2*a*, 2*b* and each vertical section has six receptors, attachment socks or ports 8-31. These attachment socks are located on an inner or interior surface of the vertical sections of the handrail at intervals of approximately every six inches starting from the floor and going up to the top where the vertical section curves. These socks 8-31 can have the form of slots, keyholes, or any aperture that has the capability to support the platform 32 and the weight of a human being.

Referring to FIG. 1, the platform 32 is preferably a rectangular shaped piece of metal, wood, plastic, or any suitable synthetic material that is made to fit tightly between the four vertical sections of the handrails 2*a*, 2*b*. The platform 32 has feet 40 which can be, but are not limited to, hooks or posts. The feet 40 can be located anywhere on each of the four corners of the platform 32. The platform 32 can also have a cover 42 (FIG. 5) for the comfort of the user or to prevent slipping. The platform cover 42 can be made of any suitable material and is preferably made of plastic, rubber, gel, cloth, or a synthetic material.

Figure 6:
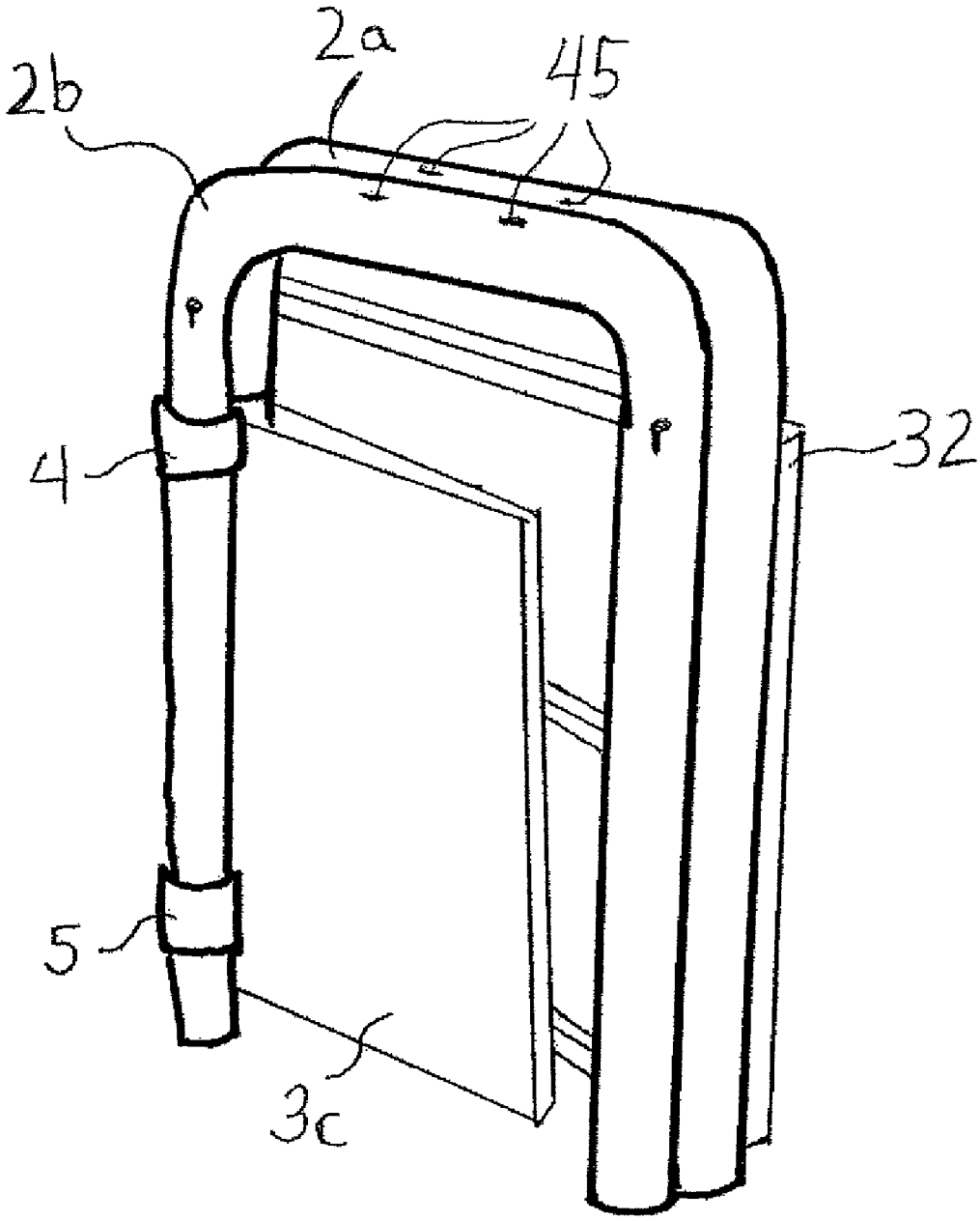
FIG. 6 is a perspective view of the embodiment of FIG. 3 shown in a compact, folded state.

The assembled device is designed to open up wide enough to attach and remove the platform 32, and to connect and disconnect the platform posts or feet 40 to or from the attachment ports 8-31 at various points, in order to accommodate a person standing between the handrails 2*a*, 2*b*. The ability to adjust the height of the platform 32 or to remove it completely makes it possible to do multiple exercises with varying degrees of difficulty. As shown in FIG. 6, with the platform 32 removed, and the exercise device no longer in use, the handrails 2*a*, 2*b* can close in on the bi-fold panel 3*c* due to the hinges 4, 5, 6, and 7 attached to all three parts, thus allowing for easy storage.

Figure 3:
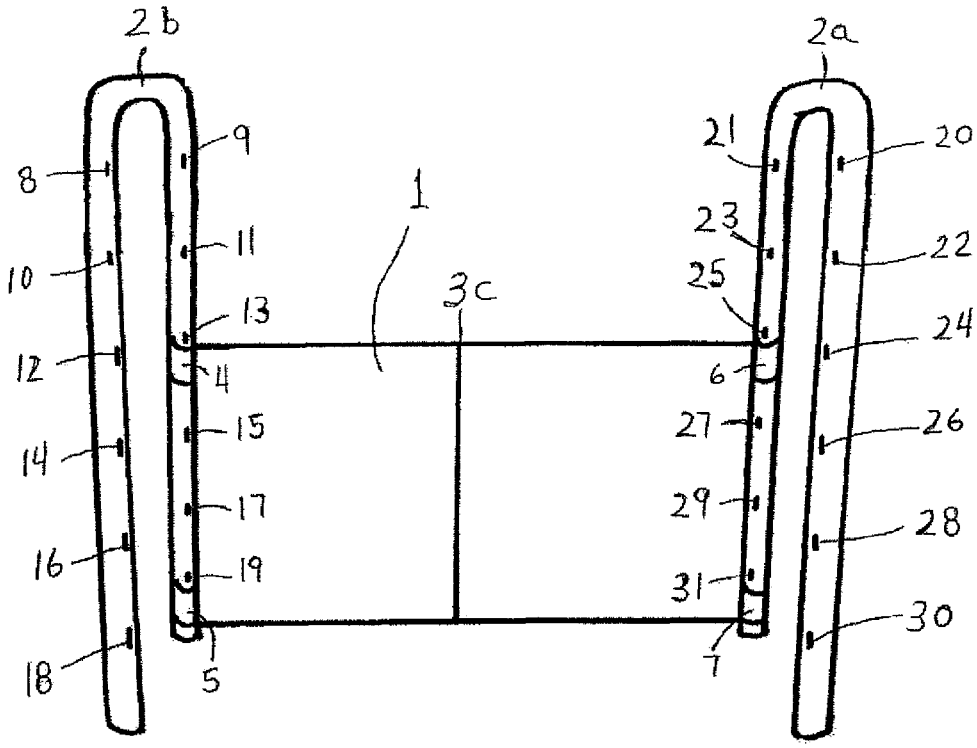
FIG. 3 is a front perspective view of another embodiment of the present portable exercise device with the platform removed and the support has a bi-fold structure.

The bi-fold panel 3*c* can be made of one solid sheet of metal, wood, or synthetic material, or combinations thereof. It could also be formed of two sheets of metal with hinges down the center (FIG. 3). Alternatively, some formation of braces and straps 3*a*, 3*b* could be used to allow the support structure 1 to fold (FIGS. 1-2).

The handrails 2*a*, 2*b* can be made of solid metal or can be formed of metal tubing that is bent into the correct shape. The metal tubing can be drilled to make keyholes or slots in the vertical sections of the handrails 2*a*, 2*b* to make the attachment ports 8-31. Alternatively, a manufacturer could weld short pieces of metal tubing at each location for the attachment ports.

The platform 32 could be as simple as a plank of wood with hooks or nails to serve as the platform feet 42. In an alternative embodiment, the platform 32 is made by bending square metal tubing into a rectangle having supporting cross braces of the same material. A thin sheet of metal is then welded over the tubing structure to create the platform 32. Welding on metal hooks, pins or sections of a smaller diameter metal tube makes platform posts or feet on such a metal construction.

Figure 4:
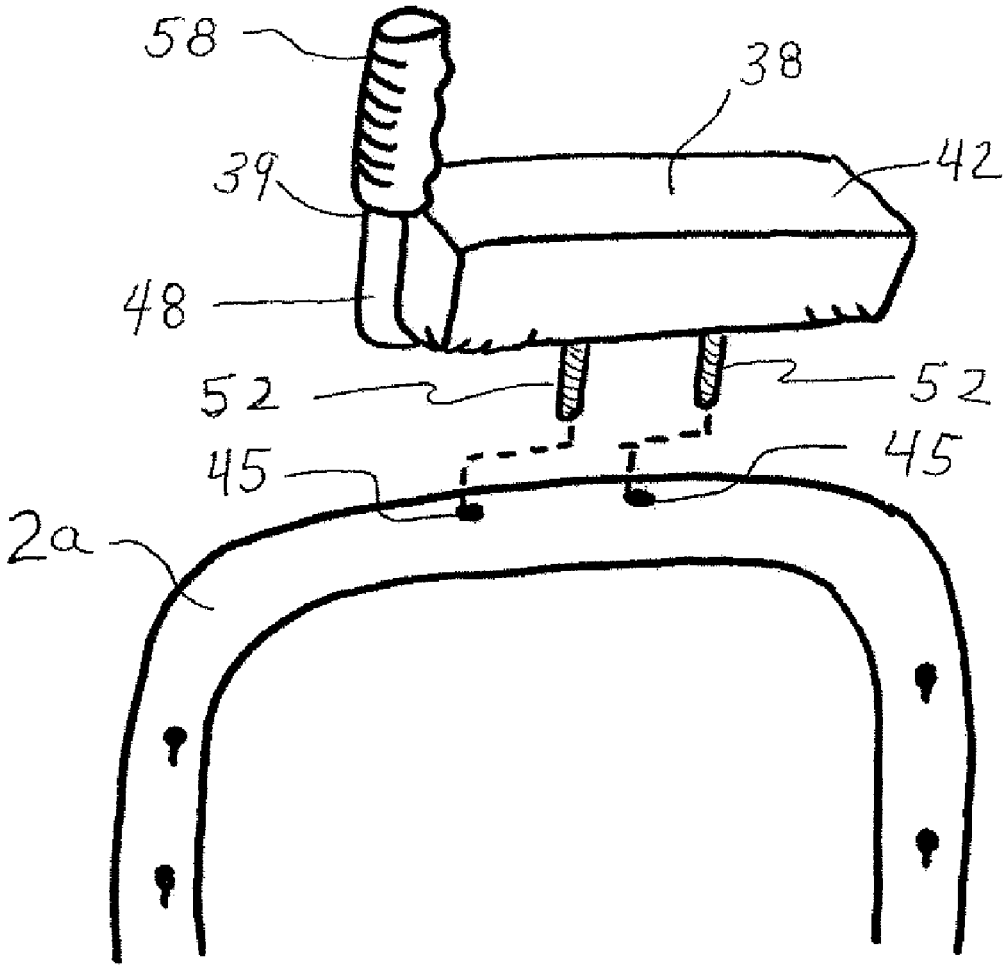
FIG. 4 is a fragmentary exploded perspective view of a removable arm pad and one of the supports of the present portable exercise device of FIG. 1 or 3.
Figure 5:
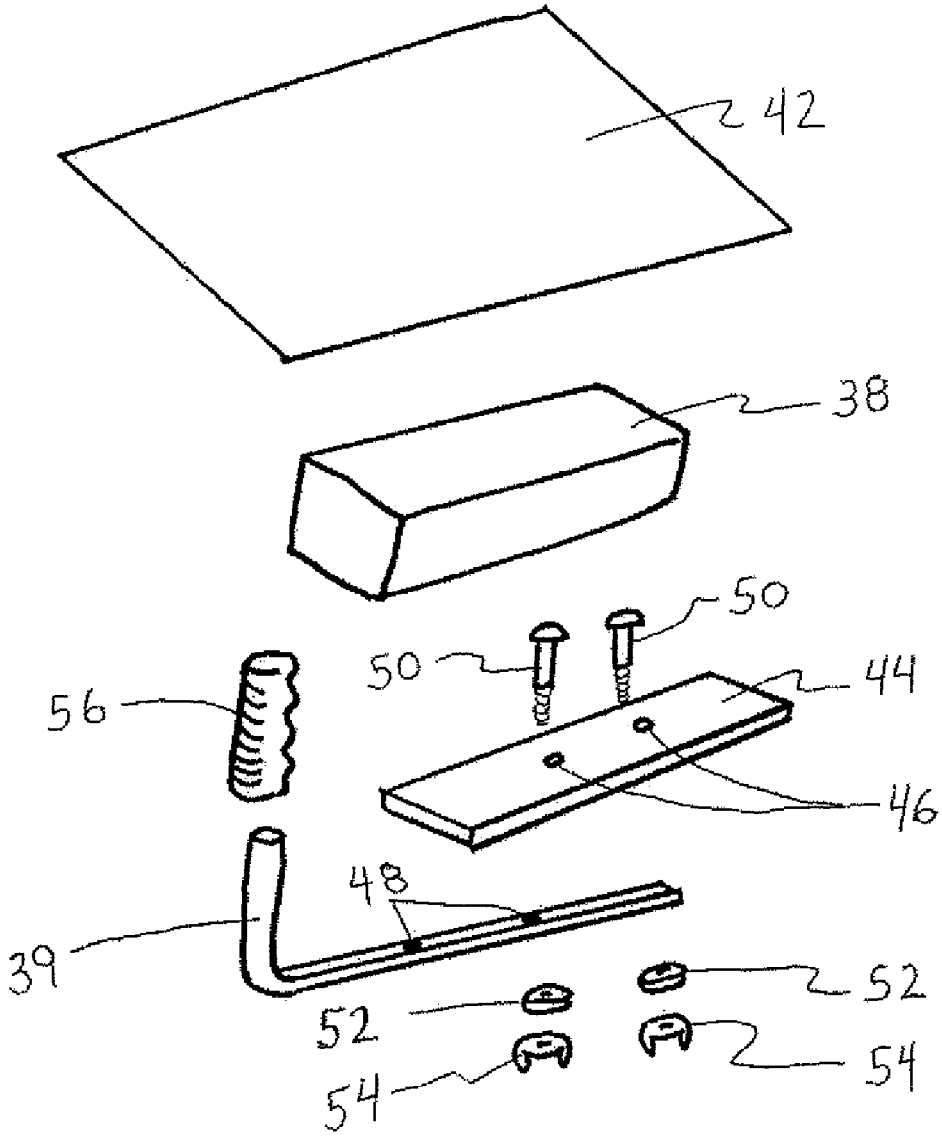
FIG. 5 is an exploded perspective view of the removable arm pad of FIG. 4.

Referring to FIGS. 4 and 5, the exercise device also includes an arm pad 38 and armrest 39 that are bolted on to the horizontal top bar of the handrails 2*a*, 2*b* for a user to grasp and support or stabilize themselves while using the device. Specifically, the arm pad 38 is positioned on a plate or board 44, which is positioned on the armrest 39. The arm pad 38 includes holes (not shown) that are aligned with holes 46 on the board 44 and holes 48 on the armrest 39. Fasteners such as threaded bolts 50 are inserted respectively through the holes in the arm pad 38, the holes 46 in the board 44 and the holes 48 in the armrest 39 and then through holes 45 defined on the top surface of the handrails 2*a* and 2*b* to secure an arm pad 38 and an armrest 39 to at least one and preferably both of the handrails. The bolts 50 are secured in place by washers 52 and wing nuts 54. A grip 56 may optionally be secured to the armrest 39 to provide comfort for a user. The arm pad 38 substantially increases the functionality of the device.

Figure 7:
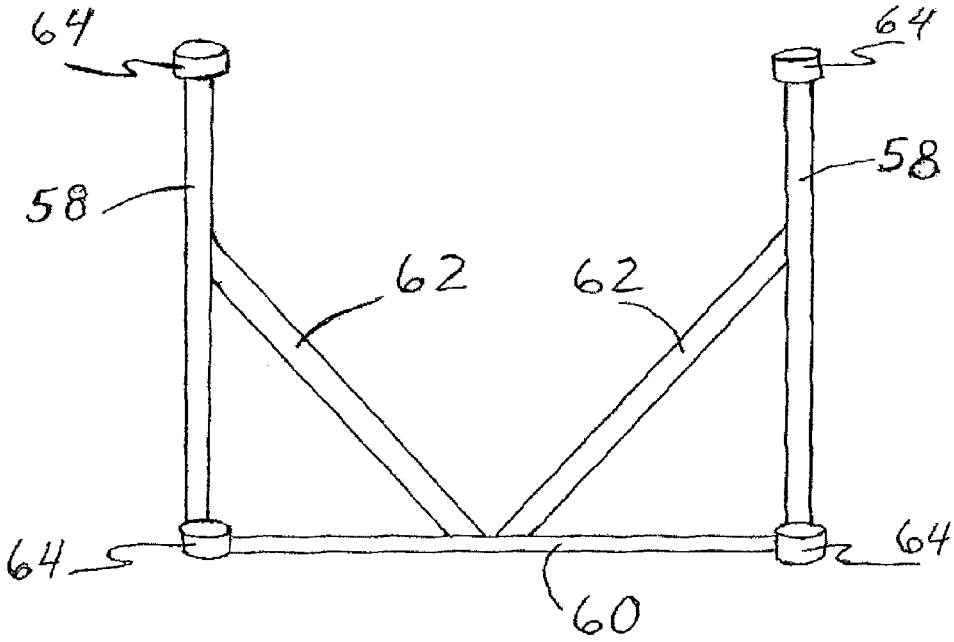
FIG. 7 is a front view of another embodiment of the support structure for the present exercise device.
Figure 8:
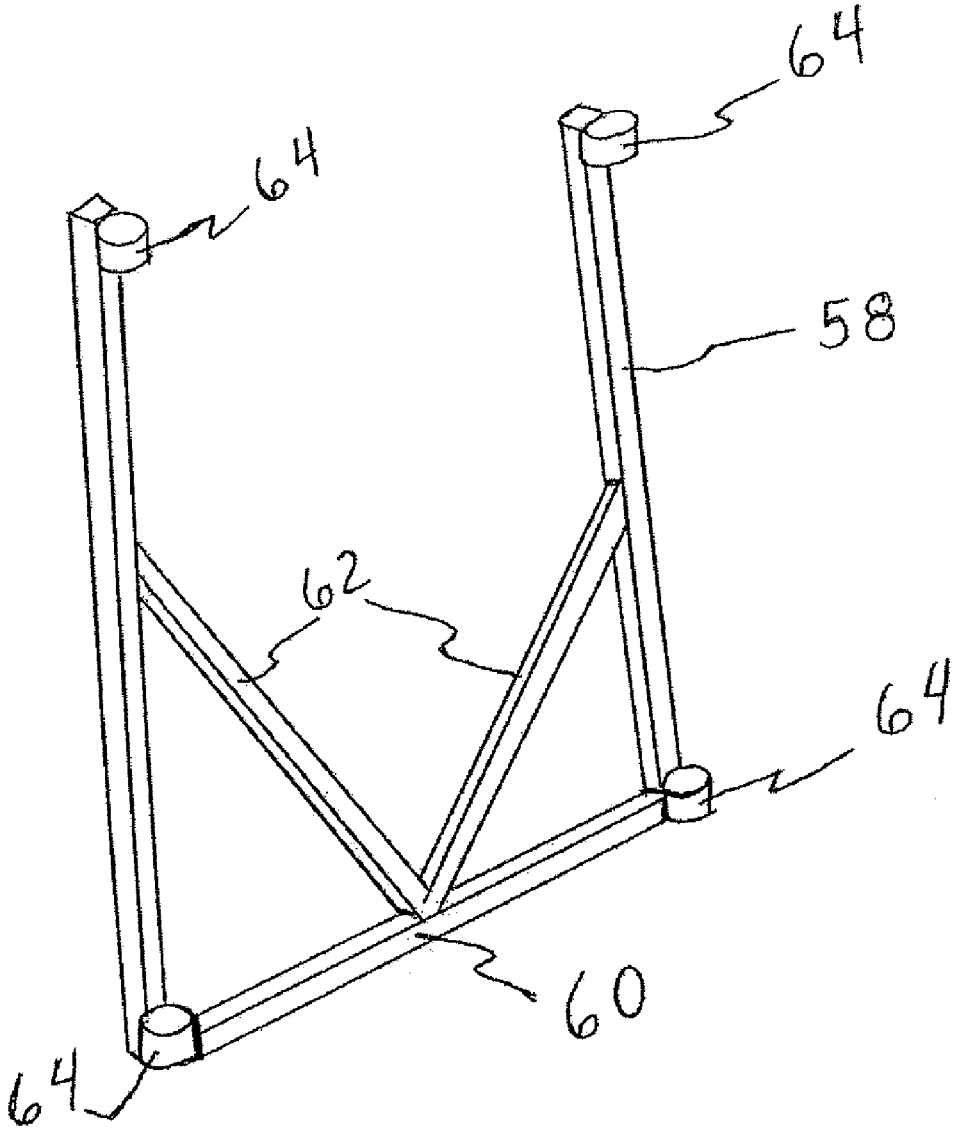
FIG. 8 is a front perspective view of the support structure of FIG. 7.
Figure 9:
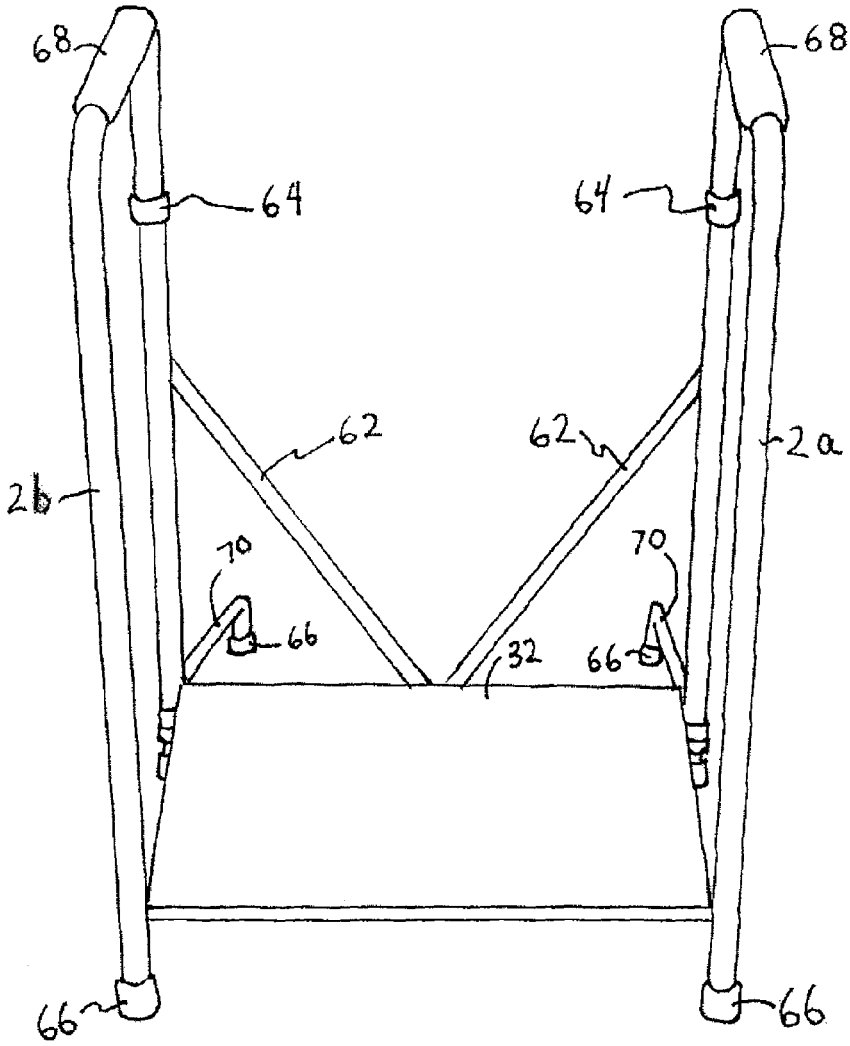
FIG. 9 is a front perspective view of the present exercise device including the support structure of FIG. 7.

Referring to FIGS. 7-9, another embodiment of the present exercise device is shown and includes support structure 1' having two generally square support posts 58 joined together by a horizontal beam 60 and angled gussets or cross beams 62 that are each connected to one of the posts and extend downwardly to a central portion of the horizontal beam. The ends of the horizontal beam 60 are welded to the posts 58. Similarly, one end of each of the gussets 62 is respectively welded to the posts 58 and the opposing ends are welded to the horizontal beam 60 as shown in FIG. 8. It should be appreciated that the posts 58, the horizontal beam 60 and the gussets 62 may be connected together by fasteners or any suitable connectors or connection methods. It should also be appreciated that the posts 58, the horizontal beam 60 and the gussets 62 are made of metal but may also be made with a composite material or any other suitable material or combination of materials.

At least one, and preferably two spaced collars 64 are connected to and extend laterally from a same side of the posts 58 as shown in FIGS. 7 and 8. Each of the collars 64 defines a throughole configured to receive an end of one of the handrails 2*a*, 2*b* such that the end of one of the handrails slides through both collars aligned on one side of the support structure 1' (see FIG. 9). After insertion of the handrails 2*a*, 2*b* through the collars 64, the rear sides of the handrails are each positioned adjacent to and in front of the posts 58. The inner diameter of the collars 64 is generally larger than an outer diameter of the handrails 2*a*, 2*b* so that the handrails can be rotated from a storage position adjacent to the support structure 1' to a use position (FIG. 9) transverse to the support structure or further outwardly if needed.

In the illustrated embodiment, one or more grips 68 may be attached to the handrails 2*a*, 2*b* to provide comfort to a user's hands during use and to help prevent a user's hands from slipping on the handrails. The grips 68 may be out of rubber or any suitable non-slip material.

The bottom ends of each of the handrails 2*a*, 2*b* include at least one foot 66 for stabilizing the exercise device on the underlying support surface. Each foot is made out of rubber or other suitable non-slip, durable material. As shown in FIG. 9, an additional L-shaped foot support 70 is movably connected to each of the handrails 2*a*, 2*b* to provide extra stability and support to the exercise device. The foot supports 70 are movable between a storage position adjacent to the support structure 1' and a use position that is generally transverse to the support structure (see FIG. 9). It should be appreciated that the foot supports 70 may be moved to any suitable position or positions relative to the support structure. Each of the foot supports 70 include at least one foot 66.

The present exercise device provides a compact, portable device that allows a user to do a full body workout. There is currently known to be available no single, portable exercise device that allows a person of any fitness level to do a variety of assisted and unassisted push-ups, step-ups and jump-ups, dips, squats, and lunges at various selected levels of difficulty. The arm pad and armrest 38, 39 provides convenience and comfort in those exercises which require the user to support part of his body weight with their arms.

While a particular embodiment of the present portable exercise device has been described herein, it will be appreciated by those skilled in the art that changes and modifications may be made without departing from the spirit and scope of the invention as set forth in the following claims.

What is claimed is:

1. A portable exercise device comprising:

a frame having a pair of upright posts;

a generally U-shaped stabilizer structure with opposing support gussets for interconnecting said upright posts;

left and right pairs of collars, each collar pair connected at an upper and lower portion of a respective post;

left and right inverted U-shaped members, each member having one end connected to a respective pair of collars;

a plurality of apertures on each U-shaped member;

a platform having a plurality of posts/pins for engaging with respective apertures;

whereby the platform is height adjustably connected to said U-shaped members;

and wherein said U-shaped members can be rotated in said collars to collapse the exercise device.

2. The exercise device of claim 1, further comprising an arm pad and an armrest connected to said arm pad, said arm pad and said armrest being secured to at least one of said U-shaped members.

3. The exercise device of claim 2, further comprising a grip secured to said armrest and configured to be grasped by a user.

4. The exercise device of claim 1, further comprising at least one foot support movably connected to each of the U-shaped members.

5. The exercise device of claim 1, further comprising a cover secured to said arm pad.

* * * * *